US006339979B1

(12) United States Patent
Chiang

(10) Patent No.: US 6,339,979 B1
(45) Date of Patent: Jan. 22, 2002

(54) ADJUSTABLE TOOL HANDLE

(76) Inventor: Che Ming Chiang, 12F, No. 342, Sec. 1, Nan King East Road, Taichung (TW), 401

( * ) Notice: Subject to any disclaimer, the term of this patent is extended or adjusted under 35 U.S.C. 154(b) by 0 days.

(21) Appl. No.: 09/687,106

(22) Filed: Oct. 16, 2000

(51) Int. Cl.[7] ..... B25G 1/04

(52) U.S. Cl. ..... 81/177.2; 81/177.7; 16/115; 403/109

(58) Field of Search ..... 81/177.2, 177.7, 81/177.85; 16/115; 403/109, 374, 377

(56) References Cited

U.S. PATENT DOCUMENTS 4,711,145 A 12/1987 Inoue
4,905,548 A * 3/1990 Colace et al. ..... 81/177.2
5,471,899 A * 12/1995 Twomlow ..... 81/177.2 X
5,931,065 A * 8/1999 Jackson et al. ..... 81/177.2
6,058,814 A * 5/2000 Johnson ..... 81/177.2

* cited by examiner

*Primary Examiner*—James G. Smith
(74) *Attorney, Agent, or Firm*—Charles E. Baxley

(57) ABSTRACT

An adjustable tool handle device includes a barrel slidably, and rotatably engaged on a handle. A channel is formed in the handle for receiving a rod and has two narrower ends. The barrel may be slided and adjusted relative to the handle when the rod is engaged in a greater middle portion of the channel of the handle. The barrel may be clamped between the barrel and the handle to secure the barrel and the handle together when the rod is engaged in either of the narrower ends of the channel of the handle. A catch may prevent the barrel from being disengaged from the handle.

9 Claims, 3 Drawing Sheets

ADJUSTABLE TOOL HANDLE

BACKGROUND OF THE INVENTION

1. Field of the Invention

The present invention relates to a tool handle, and more particularly to an adjustable tool handle.

2. Description of the Prior Art

U.S. Pat. No. 4,711,145 to Inoue discloses a typical tool handle having a bolt rotatably received in the handle body and rotated relative to the handle body to actuate a pawl to engage with a driving head and to secure the driving head relative to the handle at the required angular position. The bolt may not be slided or extended relative to the handle body such that the tool handle may not be adjusted to different lengths.

The present invention has arisen to mitigate and/or obviate the afore-described disadvantages of the conventional tool handles.

SUMMARY OF THE INVENTION

The primary objective of the present invention is to provide an adjustable tool handle which may be easily and quickly adjusted or extended or retracted to the required length.

In accordance with one aspect of the invention, there is provided an adjustable tool handle comprising a barrel including a first end, a handle body slidably received in the barrel and extendible and adjustable relative to the barrel, the handle body including a first end slidably received in the barrel and including a channel formed in the first end thereof, the channel of the handle body including two narrower ends and a greater middle portion, and a rod received in the channel of the handle body. The barrel is allowed to be slided relative to the handle body when the rod is engaged in the greater middle portion of the channel of the handle body, and the barrel is clamped between the barrel and the handle body to secure the barrel and the handle body together when the rod is engaged in either of the narrower ends of the channel of the handle body. The barrel may thus be easily and quickly adjusted or moved relative to the handle body and may be easily and quickly secured to the handle body by rotating the barrel relative to the handle body.

A retaining, means is further provided for retaining the barrel to the handle body and to prevent the barrel from being disengaged from the handle body, and includes an inner peripheral chamber formed in the first end of the barrel, a catch received in the handle body, and means for biasing the catch to engage into the inner peripheral chamber of the barrel. The barrel may thus be prevented from being disengaged from the handle body inadvertently by engaging the catch into the inner peripheral chamber of the barrel.

The barrel includes an inclined inner peripheral surface formed in the first end thereof for defining the inner peripheral chamber thereof. The handle body includes a longitudinal axis, and includes a reference surface perpendicular to the longitudinal axis of the handle body, and includes a recess formed therein for receiving the catch, and includes a first inclined surface for defining the recess of the handle body, the catch includes a surface engaged with the first inclined surface of the handle body for allowing the catch to be biased to engage with the inclined inner peripheral surface of the barrel.

A ferrule is secured to the first end of the barrel and includes a peripheral flange extended therefrom for engaging with the catch and for preventing the barrel from being disengaged from the handle body.

The handle body includes a second end, the adjustable tool handle further includes a coupler rotatably secured to the second end of the handle body with a pivot shaft and having a stud extended therefrom, a driving tool, and means for latching the driving tool to the stud of the coupler.

The latching means includes an orifice formed in the stud, a ball received in the orifice of the stud, a latch slidably received in the stud and having a cavity formed therein for receiving the ball, and means for biasing the latch to force the ball outward of the orifice of the stud and to engage with the driving tool.

The handle body includes an ear provided in the second end thereof and having a bulge formed therein and defined by at least one surface, the latch is moved against the biasing means by the bulge when the coupler is rotated relative to the handle body and when the latch is engaged with the bulge of the handle body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
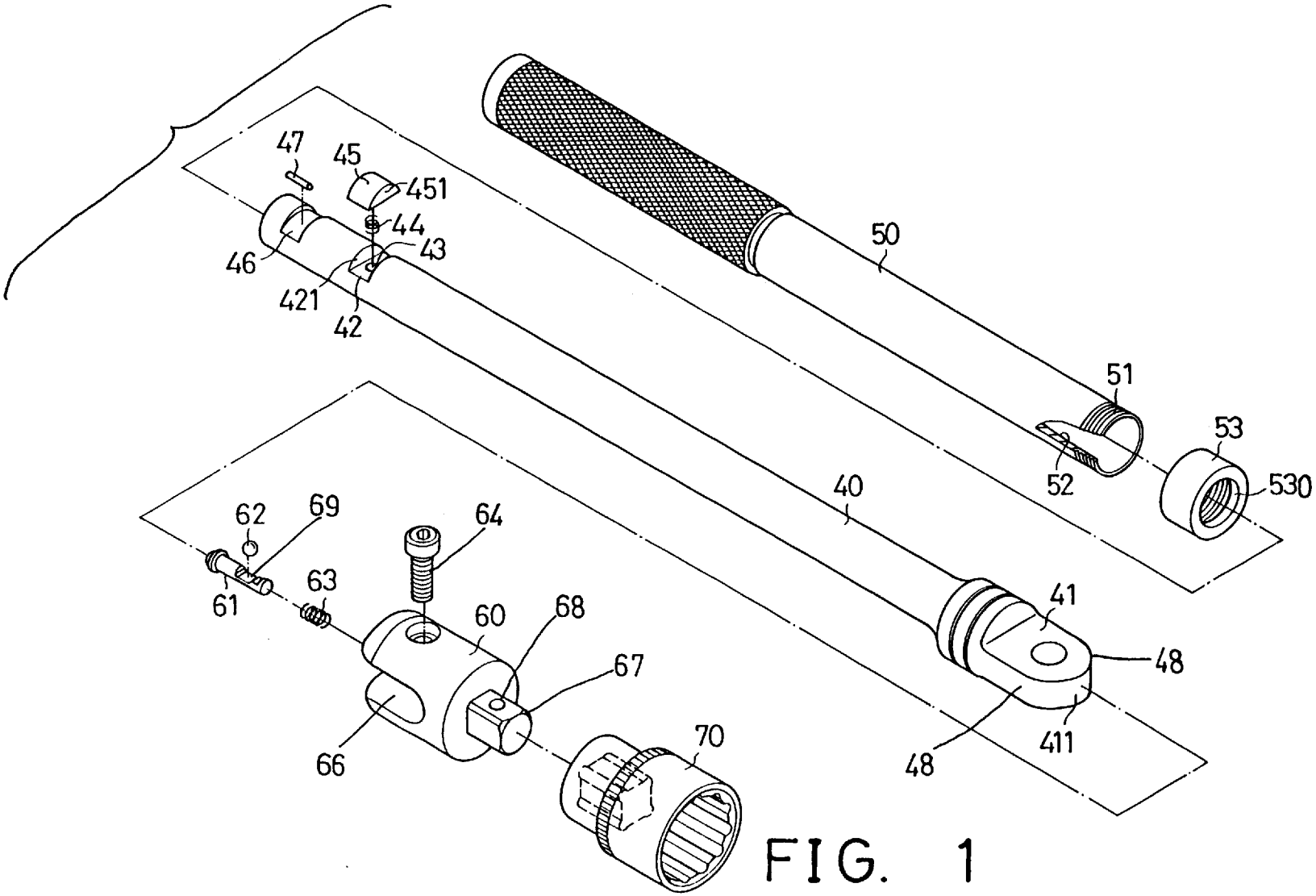
FIG. 1 is an exploded view of an adjustable tool handle in accordance with the present invention.
Figure 2:
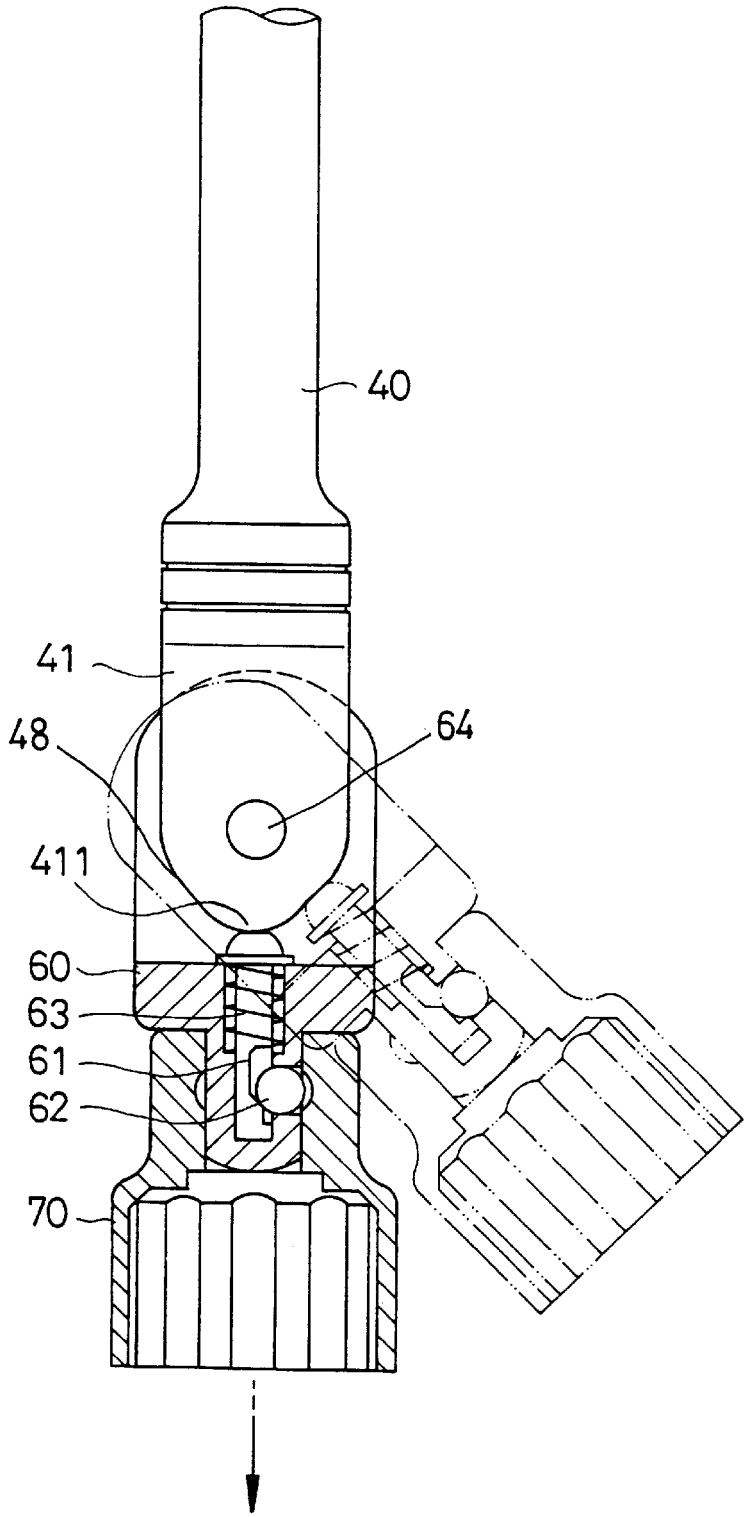
FIG. 2 is a partial cross sectional view of the driving mechanism of the tool.

Referring to the drawings, and initially to FIGS. 1 and 2, an adjustable tool handle in accordance with the present invention comprises a handle body 40 including an ear 41 formed on one end including a recess 42 and a channel 46 formed in the other end thereof. The ear 41 includes a bulge 411 formed thereon, particularly formed on the outer and middle portion thereof and defined by a pair of opposite depressions or flat surfaces 48, best shown in FIG. 2. A coupler 60 includes a slot 66 formed therein for rotatably receiving the ear 41 which is rotatably or pivotally secured to the coupler 60 with a pivot shaft 64. The coupler 60 includes a stud 67 extended therefrom for coupling to a driving tool, such as a driving socket 70, the stud 67 includes an orifice 68 formed therein for receiving a ball 62 therein. A latch 61 is slidably received in the stud 67 and extended inward of the slot 66 of the coupler 60 for engaging with the bulge 411 of the ear 41. The latch 61 includes a cavity 69 formed therein for receiving the ball 62, best shown in FIG. 2, and for allowing the driving tool 70 to be engaged onto or disengaged from the stud 67. A spring 63 is engaged with the latch 61 for biasing the latch 61 to force the ball 62 outward through the orifice 68 of the stud 67 and to engage with the driving tool 70 in order to solidly secure the driving tool 70 to the coupler 60.

In operation, as shown in solid lines in FIG. 2, when the coupler 60 is rotated relative to the handle body 40 to the position in line with the handle body 40, the bulge 411 of the ear 41 may engage with the latch 61 and may move the latch 61 against the spring in order to receive the ball 61, in the cavity 69 of the latch 61. At this moment, the driving tool 70 may be easily disengaged from the stud 67 of the coupler 60 and may be replaced with the other driving tool 70. When the coupler 60 is rotated relative to the handle body 40 to disengage the bulge 411 of the ear 41 from the latch 61, as shown in dotted lines in FIG. 2, the latch 61 may be forced to engage with the depressions or the surfaces 48 of the ear 41 and may be biased to engage with the ball 62 and to force the ball 62 to engage with the driving tool 70 and to solidly retain the driving tool 70 to the stud of the coupler 60.

Figure 4:
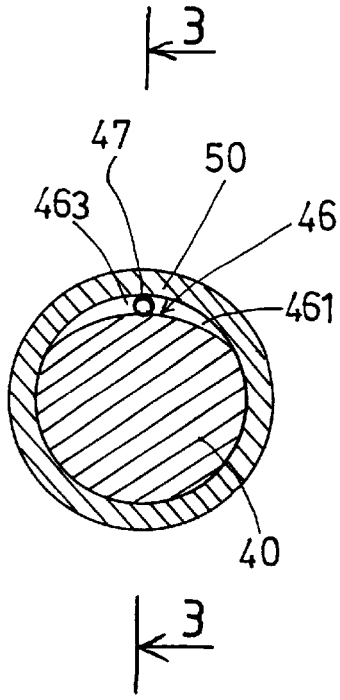
FIG. 4 is a cross sectional view taken along lines 4—4 of FIG. 3.
Figure 3:
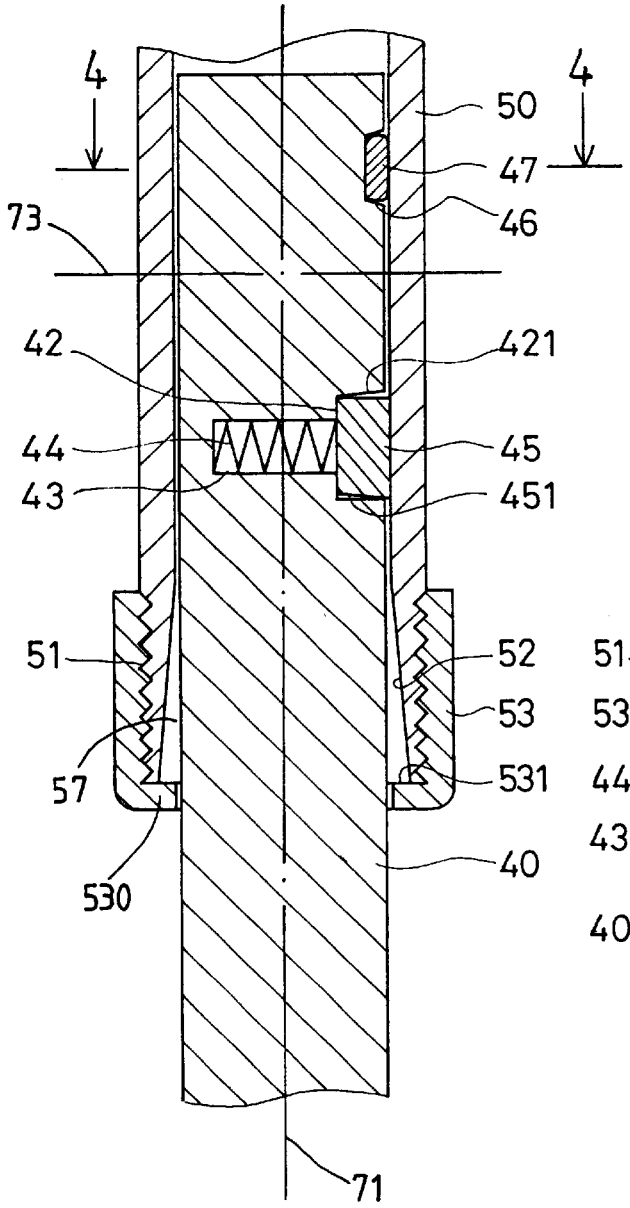
FIG. 3 is a partial cross sectional view taken along lines 3—3 of FIG. 4.
Figure 5:
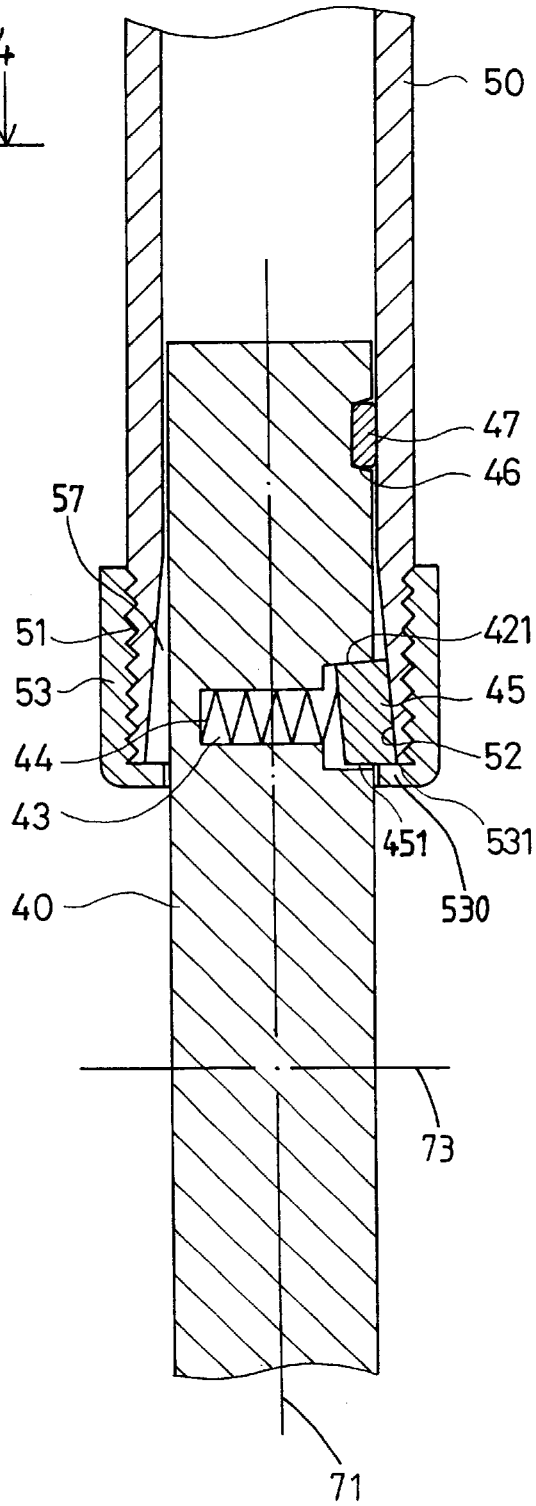
FIG. 5 is a partial cross sectional view similar to FIG. 3, illustrating the operation of the adjustable tool handle.

Referring next to FIGS. 3, 4 and again to FIG. 1, a barrel 50 is rotatably engaged on the handle body 40 and includes an outer thread 51 formed on one end, such as the front end, thereof and includes a frustum-shaped or an inclined inner peripheral surface 52 formed in the front end thereof for defining or for forming a peripheral chamber 57 between the handle body 40 and the front end of the barrel 50 (FIGS. 3, 5). A ferrule 53 is threaded to the outer thread 51 of the barrel 50 and includes one end, such as the front end, thereof having an inner peripheral flange 530 formed thereon or extended radially inward therefrom for forming an inner peripheral shoulder 531 therein (FIGS. 3, 5). A rod 47 is received in the channel 46 of the handle body 40. The channel 46 includes two narrower ends 461 having a width smaller than the outer diameter of the rod 47, and includes a greater middle portion 463 (FIG. 4) having a width no less than the outer diameter of the rod 47.

In operation, when the barrel 50 is rotated relative to the handle body 40 to receive the rod 47 in the greater middle portion 463 of the channel 46 of the handle body 40, the barrel 50 may be slided relative to the handle body 40 to any suitable or selected position relative to the handle body 40. When the barrel 50 is rotated relative to the handle body 40, the rod 47 may be forced to engage in either of the narrower ends 461 of the channel 46 of the channel body 40 and to be engaged between the barrel 50 and the handle body 40 in order to secure the barrel 50 and the handle body 40 together. The barrel 50 may thus be easily and quickly extended or adjusted relative to the handle body 40 and may be easily and quickly secured to the handle body 40 at the required relative position when the rod 47 is forced to be engaged or clamped between the barrel 50 and the handle body 40.

As shown in FIGS. 1 and 3, the handle body 40 includes one or more surfaces 421 for defining the recess 42 thereof, and includes an aperture 43 formed therein and communicating with the recess 42 thereof for receiving a spring 44 therein. A catch 45 is slidably received in the recess 42 of the handle body 40 and engaged with the spring 44 and includes one or more surfaces 451 for engaging with the corresponding surfaces 421 of the handle body 40. The catch 45 may be biased inward of the peripheral chamber 57 of the barrel 50 (FIG. 5) when the barrel 50 is slided relative to the handle body 40. As best shown in FIGS. 3 and 5, the surfaces 431, 451 of the handle body 40 and of the catch 45 are not perpendicular to the longitudinal axis 71 of the handle body 40 and are inclined relative to a reference line or surface 73 that is perpendicular to the longitudinal axis 71 of the handle body 40, such that the catch 45 may be biased into the peripheral chamber 57 of the barrel 50 and to engage with the inclined inner peripheral surface 52 of the barrel 50 and to engage with the peripheral shoulder 531 and the peripheral flange 530 of the ferrule 53.

In operation, as shown in FIG. 5, when the barrel 50 is moved relative to the handle body 40 until the catch 45 is biased to engage into the peripheral chamber 57 of the barrel 50 and to engage with the peripheral flange 530 of the ferrule 53, the catch 45 may limit the further relative movement between the barrel 50 and the handle body 40 and may prevent the barrel 50 from being disengaged from the handle body 40.

Accordingly, the adjustable tool handle in accordance with the present invention may be easily and quickly adjusted or extended or retracted to the required length and may prevent the barrel from being disengaged from the handle body.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable tool handle comprising:

a barrel including a first end, a handle body slidably received in said barrel and extendible and adjustable relative to said barrel, said handle body including a first end slidably received in said barrel and including a channel formed in said first end thereof, said channel of said handle body including two narrower ends and a greater middle portion, and a rod received in said channel of said handle body, said barrel being allowed to be slided relative to said handle body when said rod is engaged in said greater middle portion of said channel of said handle body, and said barrel being clamped between said barrel and said handle body to secure said barrel and said handle body together when said rod is engaged in either of said narrower ends of said channel of said handle body.

2. The adjustable tool handle according to claim 1 further comprising retaining means for retaining said barrel to said handle body and to prevent said barrel from being disengaged from said handle body.

3. The adjustable tool handle according to claim 2, wherein said retaining means includes an inner peripheral chamber formed in said first end of said barrel, a catch received in said handle body, and means for biasing said catch to engage into said inner peripheral chamber of said barrel.

4. The adjustable tool handle according to claim 3, wherein said barrel includes an inclined inner peripheral surface formed in said first end thereof for defining said inner peripheral chamber thereof.

5. The adjustable tool handle according to claim 4, wherein said handle body includes a longitudinal axis, and includes a reference surface perpendicular to said longitudinal axis of said handle body, and includes a recess formed therein for receiving said catch, and includes a first inclined surface for defining said recess of said handle body, said catch includes a surface engaged with said first inclined surface of said handle body for allowing said catch to be biased to engage with said inclined inner peripheral surface of said barrel.

6. The adjustable tool handle according to claim 3 further comprising a ferrule secured to said first end of said barrel, said ferrule including a peripheral flange extended therefrom for engaging with said catch and for preventing said barrel from being disengaged from said handle body.

7. The adjustable tool handle according to claim 1, wherein said handle body includes a second end, said adjustable tool handle further includes a coupler rotatably secured to said second end of said handle body with a pivot shaft and having a stud extended therefrom, a driving tool, and means for latching said driving tool to said stud of said coupler.

8. The adjustable tool handle according to claim 7, wherein said latching means includes an orifice formed in said stud, a ball received in said orifice of said stud, a latch slidably received in said stud and having a cavity formed therein for receiving said ball, and means for biasing, said latch to force said ball outward of said orifice of said stud and to engage with said driving tool.

9. The adjustable tool handle according to claim 8, wherein said handle body includes an ear provided in said second end thereof and having a bulge formed therein and defined by at least one surface, said latch is moved against said biasing means by said bulge when said coupler is rotated relative to said handle body and when said latch is engaged with said bulge of said handle body.

* * * * *